United States Patent [19]

Pittman et al.

[11] 4,142,768

[45] Mar. 6, 1979

[54] CONNECTOR BLOCK

[75] Inventors: Robert B. Pittman, River Edge, N.J.; Michael Offerman, Merrick, N.Y.

[73] Assignee: Industrial Electronic Hardware, New York, N.Y.

[21] Appl. No.: 844,445

[22] Filed: Oct. 21, 1977

[51] Int. Cl.[2] ..... H01R 9/16; H01R 31/08

[52] U.S. Cl. ..... 339/19; 339/198 P; 339/217 S

[58] Field of Search ..... 339/19, 217 S, 198 R, 339/198 P, 198 S, 198 N, 18 R, 18 B, 18 P

[56] References Cited

U.S. PATENT DOCUMENTS

| | | | |
|---|---|---|---|
| 3,256,510 | 6/1966 | Van Horssen | 339/217 S |
| 3,550,067 | 12/1970 | Hansen | 339/217 S |
| 3,714,618 | 1/1973 | Appleton | 339/19 |

*Primary Examiner*—Neil Abrams

*Attorney, Agent, or Firm*—James & Franklin

[57] ABSTRACT

A connector block having at least one internally bussed section comprises an electrically insulating housing having top and bottom faces and an electrically conductive buss contact. The housing has exposed on one face a plurality of apertures adapted to receive leads and exposed on an opposite face a plurality of first openings in line and communicating with the apertures respectively and a second opening bridging sides of and communicating with the plurality of first openings. The electrically conductive buss contact is disposed in the second opening and insertable thereinto through the opposite face. The buss contact comprises a body portion disposed in the second opening, a plurality of contact portions resiliently extending from the body portion and into the associated first openings respectively for contact with leads inserted through the associated apertures and associated first openings. The housing further includes intermediate the faces a pair of oppositely facing ledges which cooperate with oppositely facing stop portions of the buss contact to limit movement of the buss contact from its designated position within the housing.

5 Claims, 4 Drawing Figures

10
12
12'
14
16
18
20
22
30
34
38
40
42
60
62
3
4

10
12
12'
14
18
20
32
34
40
50
55
56
109
110
120
150
160
164

CONNECTOR BLOCK

BACKGROUND OF THE INVENTION

The present invention relates to a connector block, and more particularly to such a connector block having at least one internally bussed section.

Where a number of male leads are to be connected to a number of female leads, it is known to use a connector block in order to maintain the male/female connections in a neat, orderly, protected and at least semi-permanent fashion. Conventional connector blocks, however, fail to provide satisfactory means for bringing three or more of these leads to a common potential. Accordingly it is generally necessary to use a separate commonly bussed block in association with the connector block in order to provide means for bringing three or more of the terminals to the same potential. The use of the connector block and the commonly bussed block in conjunction with one another is not entirely satisfactory for this purpose, however, as relatively long leads are required for passage between the blocks. Furthermore, the known commonly bussed blocks more or less permanently secure the leads attached thereto and do not enable their easy removal without the use of special equipment.

Accordingly, it is an object of the present invention to provide a connector block having at least one internally bussed section.

It is a further object to provide such a connector block wherein leads may be easily inserted into and removed from the internally bussed section.

It is a further object to provide such a connector block which is of sturdy compact construction, yet simple and inexpensive to manufacture.

SUMMARY OF THE INVENTION

It has now been found that the above and related objects of the present invention are provided in a connector block having at least one internally bussed section comprising an electrically insulating housing and an electrically conductive buss contact. The housing has exposed on one face thereof a plurality of apertures adapted to receive leads, and exposed on an opposite face thereof a plurality of first openings and a second opening. The first openings are in line with and communicate with the apertures, while the second opening bridges sides of and communicates with the plurality of first openings.

The buss contact is disposed in the second opening and is insertable thereinto through the opposite face. It comprises a body portion disposed in the second opening and a plurality of contact portions resiliently extending from the body portion and into associated first openings, respectively, for contact with leads inserted through the associated apertures and into the associated first openings.

In order to maintain the buss contact in its desired position within the connector block housing, the housing is provided, intermediate its faces, with a first ledge facing one face and a second ledge facing the opposite face. A first stop portion of the buss contact is engageable with the second ledge to limit movement of the buss contact in the direction of the one face, and a second stop portion extends from the buss contact and is engageable with the first ledge to limit movement of the buss contact in the direction of the opposite face. Preferably the first ledge is disposed in the second opening intermediate an adjacent pair of the first openings and the second ledge is disposed in an associated one of the first openings.

In a preferred embodiment, the housing includes at least one connector section having disposed on one face a plurality of second apertures adapted to receive leads, and having exposed on the opposite face a plurality of third openings in line with and communicating with the second apertures, respectively. Intermediate the one and opposite faces, third and fourth ledges are provided facing the one face and the opposite face, respectively. The third and fourth ledges are adapted to cooperate with a special female lead head disposed in the third opening and being insertable thereinto through the one face, thereby to maintain the lead head in appropriate position for receipt of a male lead head.

DETAILED DESCRIPTION OF THE PREFERRED EMBODIMENTS

Figure 1:
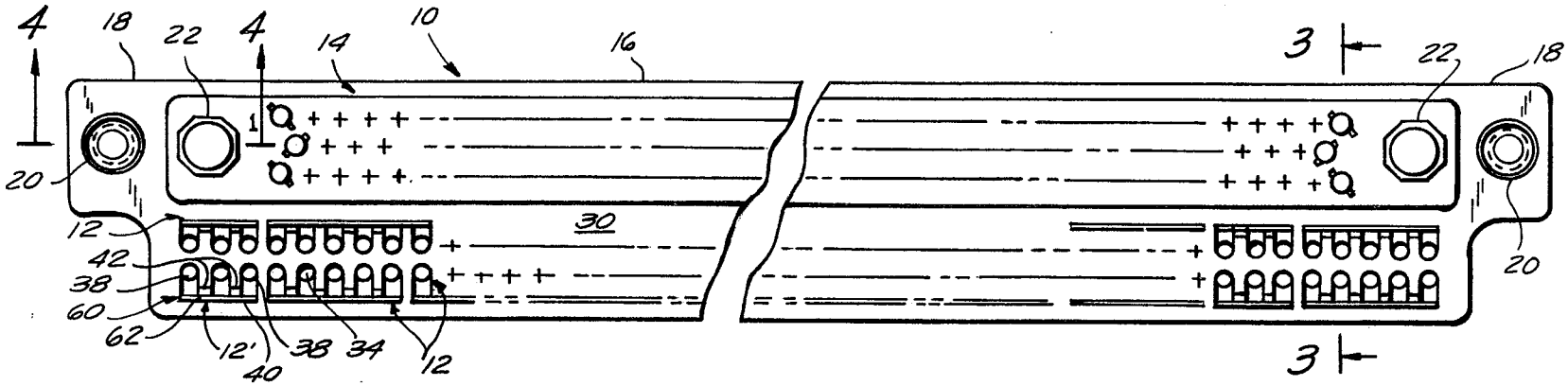
FIG. 1 is a fragmentary top plan view of a connector block according to the present invention.
Figure 2:
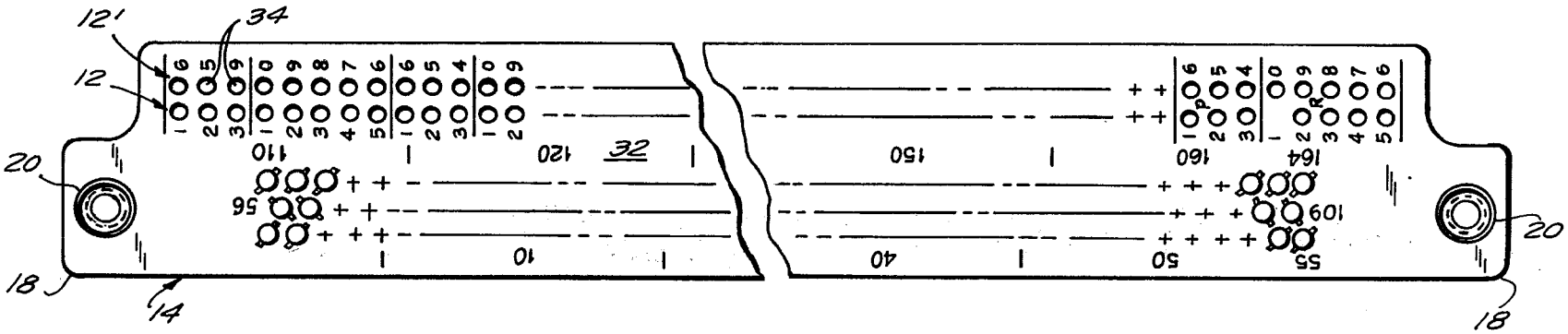
FIG. 2 is a fragmentary bottom plan thereof.
Figures 3, 4:
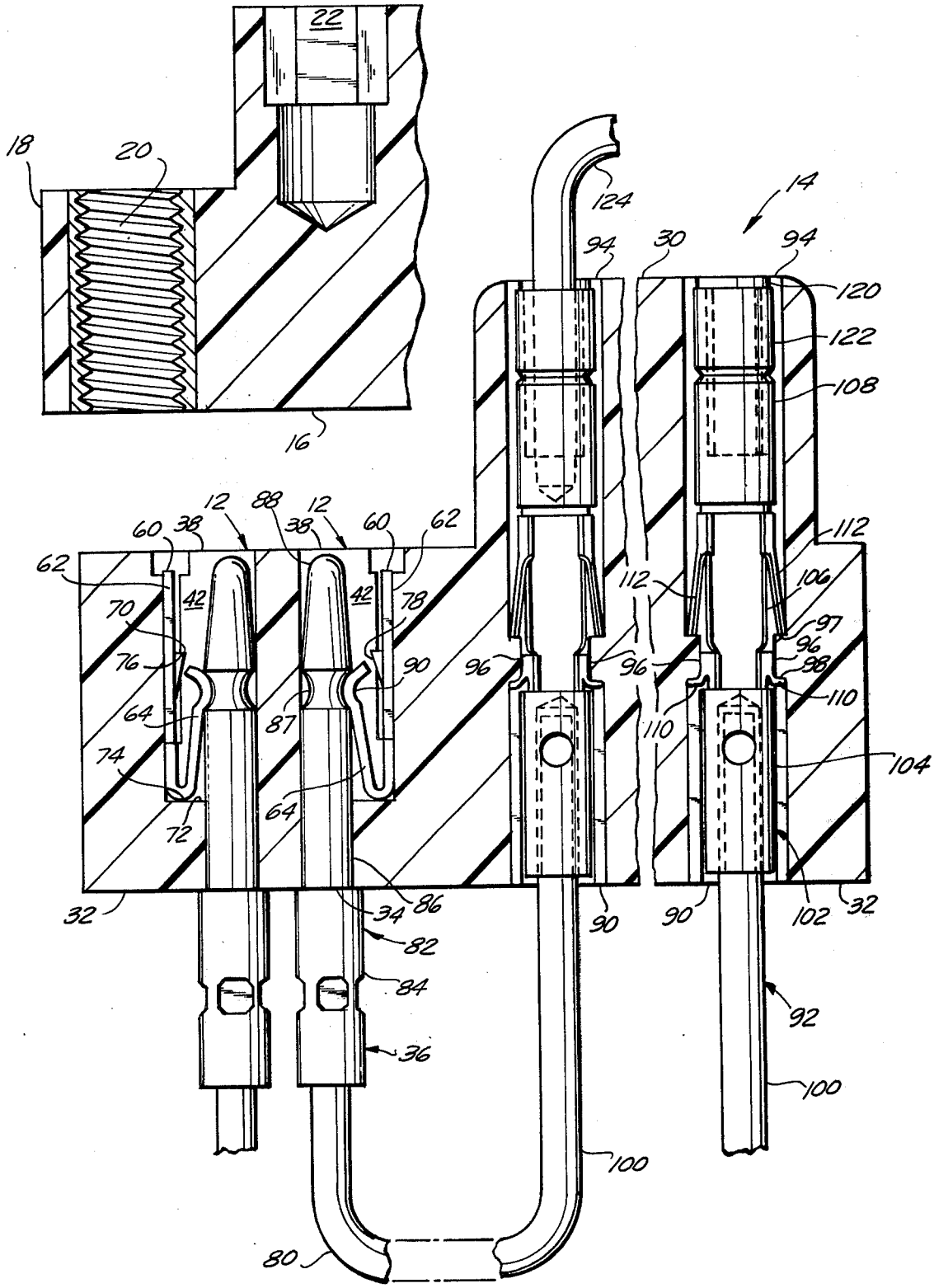
FIG. 3 is an end elevation view thereof, partially in cross-section and to an enlarged scale, taken along the line 3—3 of FIG. 1, with fragments of various leads being shown in position.
FIG. 4 is a side elevation view thereof, partially in cross-section and to an enlarged scale, taken along the line 4—4 of FIG. 1.

Referring now to the drawing, and in particular to FIGS. 1–2 thereof, therein illustrated is a connector block generally designated 10 and comprised of a plurality of internally bussed sections, generally designated 12, and a connector section, generally designated 14. The housing 16 is formed of a conventional electrical insulation material and is generally rectangular in outline, but provided with outwardly extending ears 18. As illustrated in FIG. 4, each ear 18 defines an internally threaded aperture 20 to enable conventional mounting of the housing 16 on a support (not shown) by screws. As is conventional in connector blocks, the housing 16 is further provided with a pair of octagonal apertures 22 adjacent the apertures 20, the octagonal apertures 22 being designed to permit installation of key receptacles (not shown) by the ultimate user, each key receptacle in turn being adapted to mate with given keys on the support and thus insures that the correct connector block 10 in its proper orientation is being secured to the appropriate support.

Referring now in particular to FIGS. 1–3, each internally bussed section 12 includes a top or front face 30 and a bottom or rear face 32. Disposed on the bottom face 32 are a plurality of apertures 34 adapted to receive leads, such as the crimped type buss pins 36 described hereinafter. Exposed on the opposite top face 30 are a plurality of first openings 38, each opening 38 being vertically in line with and communicating with an associated one of the apertures 34. A second or bridging opening 40 bridges one side of each of the plurality of the first openings 38 and communicates with such plurality of first openings 38. As illustrated in representative internally bussed section 12' there are three such apertures 34, three such first openings 38 and one second or bridging opening 40. The two portions of the housing 16 extending transverse to the block axis intermediate the openings 38 of the section 12' are in effect insulative lugs 42 separating the pins 36 in any one opening 38 from the pins 36 in an adjacent opening 38.

An electrically conductive buss contact generally designated 60 is disposed in the bridging opening 40. The buss contact 60 comprises a body portion 62 disposed in the bridging opening 40, and a plurality of contact portions 64 which resiliently extend from the body portion 62 into each of the first openings 38 associated with the bridging opening 40, for contact with such pins 36 as may be inserted through the associated apertures 34 and into the associated openings 38. The buss contact 60 is insertable into the bridging opening 40 through the top face 30, with the contact portions 64 being disposed on each side of one of the lugs 42 associated with that internally bussed section 12.

In order to insure that the buss contact 60 remains in place once inserted, the housing 16 is provided intermediate faces 30, 32 with a first ledge 70 facing the bottom face 32 and a second ledge 72 facing the top face 30. The buss contact 60 is provided with a plurality of first stop portions 74 (illustrated in FIG. 3 as being the intersections of each contact portion 64 and the body portion 62) engageable with the second ledge 72 to limit movement of the buss contact 60 in the direction of the bottom face 32 and a plurality of second stop portions 76 extending from the buss contact 60 (illustrated in FIG. 3 as a part of tabs 78) and engageable with the first ledge 70 to limit movement of the buss contact 60 in the direction of the top face 30. It will be appreciated that whereas each first stop portion 74 is disposed within a first opening 38 (that is, it is situated on one side of a lug 42), each second stop portion 76 is situated intermediate and adjacent first openings 38 so as to engage the downwardly facing ledge 70 of the lug 42. In order to enable insertion of the buss contact 60 into the bridging opening 40, the tabs 78 must be sufficiently resilient to enable them to pass through the portion of the bridging opening 40 above the ledge 70; that is, they must be capable of retreating into the buss contact body portion 62 sufficiently to enable passage of the body portion 62 and tabs 78 through the opposing surfaces of lug portion 42 on one side and housing 16 on the other side. Tabs 78 may be simple cutouts from the body portion 62, the tabs 78 being bowed outwardly sufficiently to enable them to engage with the ledges 70 once the buss contact 60 has been inserted to its proper depth.

Now that a typical internally bussed section 12' has been described, it will be readily apparent that the connector block 10 may be provided with a series of such internally bussed sections 12 aligned along its long axis to provide a series of separately internally bussed sections, each such section being adapted to receive the same or a different number of pins. Indeed, as illustrated, there may be a plurality of series of such internally bussed sections disposed in side-by-side relationship. Should it turn out that for a given application there are more leads to be commonly bussed than there are apertures 34 in a given internally bussed section 12, a double header jumper pin (not shown) may be used (with one head inserted in an aperture 34 of one internally bussed section 12 and the other head inserted in an aperture 34 of an adjacent internally bussed section 12) to provide common external bussing of the two internally bussed sections 12.

Refer now to FIG. 3, a pin, generally designated 36 and adapted for use in an internally bussed section 12, comprises a wire 80 having crimped on one end thereof a relatively rigid metal head 82. The head 82 in turn comprises a relatively large diameter base portion 84 which is crimped about the end of wire 80 (and serves to limit insertion of the head 82 into the aperture 34), a generally cylindrical intermediate portion 86 provided with a circumferentially extending groove 87, and a smoothly tapering tip 88 which is disposed below the top housing face 30 when the base portion 84 abuts the housing bottom face 32. The groove 87 is configured and dimensioned to enable the arcuate end portion 90 of the conductive buss contact portion 64 to enter therein and secure the head 82 against accidental displacement, while still enabling forceful withdrawal of the head 82 from the opening 38.

The connector section 14 of housing 16 may consist of one or more rows (as illustrated, three parallel rows) extending parallel to the internally bussed sections 12 along the main axis of the connector block 10. It has exposed on the bottom face 32 thereof a plurality of apertures 90, each adapted to receive a lead 92, and exposed on the top face 30 thereof a plurality of openings 94, each opening 94 being in line with and communicating with an associated one of the apertures 90. The interior of the housing 16 defining the apertures 90 includes, intermediate faces 30 and 32, two opposed inwardly projecting lug portions 96, the top of each lug portion 96 defining a ledge 97 facing the top housing wall 30 and the bottom of each lug portion 96 defining a ledge 98 facing the bottom housing face 32. The apertures 90 are adapted to be used with leads 92 of the type described in U.S. Pat. Nos. 3,023,789; 3,107,966, 3,229,356, 3,470,577 and 3,557,428. Each lead 92 is comprised of a wire 100 and a head generally designated 102. Each head 102 comprises in turn a base portion 104 adapted to be crimped about one end of the wire 100, an intermediate portion 106, and a front portion 108 adapted to receive a special pin. The intermediate portion 106 includes adjacent the back thereof a pair of relatively rigid outwardly projecting flanges 110 and adjacent the front thereof a pair of resilient wings 112 rearwardly and outwardly directed relative to the intermediate portion 106. The apertures 90 are configured and dimensioned to enable insertion of a head 102 thereinto only when the wings 112 and flanges 110 are aligned with the lug portions 96. The wings 112 are capable of retreating to a position close to the body of the intermediate portion 106 as the head 102 is inserted through bottom housing face 32 into aperture 90 and past lug portions 96 after which they extend themselves outwardly to abut top ledges 97 and thereby preclude withdrawal of the head 102 downwardly from the connector section 14. The length of the lug portion 96 (that is, the vertical spacing therebetween the ledges 97 and 98) is such that, when the rear tips of the wings 112 abut the top ledges 97, the flanges 110 abut the bottom ledges, thereby to prevent movement of the head 102 upwardly from the connector section. Thus wings 112 and flanges 110 cooperate with lug portions 96 to immobilize the intermediate head portion 106 (and hence the entire head 102) relative to the aperture 90 (and hence the entire connector section 14) along the vertical axis. Removal of the head 102 from the connector section 14 is possible only with use of a special tool which is inserted through opening 94 and causes wings 112 to retreat inwardly beyond the innermost extents of lug portions 96, thus enabling the lead head 102 to be downwardly displaced relative to the connector section 14.

The top portion 108 of head 102 is comprised of an inner sleeve 120, an outer sleeve 122 and wires connecting the inner sleeve to the outer sleeve in such a manner as to enable the wire lead 124 to be inserted into the inner sleeve 120 using low insertion force, to maintain the lead 124 within the inner sleeve 120 with a high degree of reliability, and to connect the lead 124 to the head 102 of pin 92 with low electrical resistance.

Where it is desired to connect a wire lead 124 to an internally bussed section 12, a wire having a head 82 at one end and a head 102 at the other end is employed with the head 82 disposed in the internally bussed section 12 and the head 102 disposed in the connector section 14 and ready to receive the lead 124.

The disposition of the connection section and the internally bussed sections in a single compact connector block enables particular leads introduced into the connector section to be commonly bussed in the internally bussed sections without the use of additional equipment and without requiring long leads extending between different blocks. Furthermore the novel internally bussed sections enable the leads inserted therein to be firmly retained during normal use yet easily removable with the application of only manual force, all without injury to the lead.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing disclosure.

We claim:

1. A connector block having at least one internally bussed section comprising:

(A) an electrically insulating housing comprising top and bottom faces, said housing having exposed on one face a plurality of apertures adapted to receive leads and having exposed on an opposite face a plurality of first openings in line with and communicating with said apertures respectively and a second opening bridging sides of and communicating with said plurality of first openings; said housing having intermediate said faces a first ledge facing said one face and a second ledge facing said opposite face, said first ledge being disposed in said second opening intermediate an adjacent pair of said first openings; and (B) an electrically conductive buss contact disposed in said second opening and being insertable thereinto through said opposite face, said buss contact comprising a body portion disposed in said second openings, a plurality of contact portions resiliently extending from said body portion and into associated first openings respectively for contact with leads inserted through said associated apertures and into said associated first openings, a first stop portion on said buss contact being engageable with said second ledge to limit movement of said buss contact in the direction of said one face, and a second stop portion extending from said buss contact and being engageable with said first ledge to limit movement of said buss contact in the direction of said opposite face.

2. The connector block of claim 1 wherein said second ledge is disposed in one of said first openings.

3. The connector block of claim 1 wherein said first and second stop portions are substantially spaced along the longitudinal axis of said buss contact.

4. A connector block having at least one internally bussed section and at least one connecting section comprising:

(A) an electrically insulating housing comprising top and bottom faces; said housing in said internally bussed section having exposed on one face a plurality of apertures adapted to receive leads and having exposed on an opposite face a plurality of first openings in line with and communicating with said apertures respectively and a second opening bridging sides of and communicating with said plurality of first openings; said housing having intermediate said faces a first ledge facing said one face and a second ledge facing said opposite face; said housing in said connector section having exposed on said one face a plurality of second apertures adapted to receive leads, having exposed on said opposite face a plurality of third openings in line with and communicating with said second apertures, respectively, and having intermediate said faces for each aligned set of a second aperture and a third opening a restricted section defining a third ledge facing said one face and a fourth ledge facing said opposite face; and (B) an electrically conductive buss contact disposed in said second opening and being insertable thereinto through said opposite face, said buss contact comprising a body portion disposed in said second opening, a plurality of contact portions resiliently extending from said body portion and into associated first openings respectively for contact with leads inserted through said associated apertures and into said associated first openings, a first stop portion on said buss contact being engageable with said second ledge to limit movement of said buss contact in the direction of said one face, and a second stop portion extending from said buss contact and being engageable with said first ledge to limit movement of said buss contact in the direction of said opposite face.

5. The connector block of claim 4 wherein said third ledge is closer to said one face than is said fourth ledge, and said fourth ledge is closer to said opposite face than is said third ledge.

* * * * *